US006659492B2

(12) United States Patent
Gousie

(10) Patent No.: US 6,659,492 B2
(45) Date of Patent: Dec. 9, 2003

(54) SKI FOR UPHILL AND DOWNHILL SKIING

(76) Inventor: Michael B. Gousie, 16 Cliff Dr., Plainville, MA (US) 02762

( * ) Notice: Subject to any disclaimer, the term of this patent is extended or adjusted under 35 U.S.C. 154(b) by 16 days.

(21) Appl. No.: 09/999,485

(22) Filed: Nov. 15, 2001

(65) Prior Publication Data

US 2003/0090086 A1 May 15, 2003

(51) Int. Cl.[7] ..... A63C 5/04
(52) U.S. Cl. ..... 280/604; 280/609
(58) Field of Search ..... 280/604, 609, 280/11.18, 809, 28.11

(56) References Cited

U.S. PATENT DOCUMENTS

| | | | | | |
|---|---|---|---|---|---|
| 2,248,008 | A | * | 7/1941 | Miesen | 280/604 |
| 2,287,252 | A | * | 6/1942 | Kaufmann | 280/604 |
| 4,027,895 | A | | 6/1977 | Larsson | |
| 4,148,500 | A | * | 4/1979 | Nidecker | 280/604 |
| 4,377,297 | A | | 3/1983 | Staufer | |
| 4,398,746 | A | * | 8/1983 | Heintz | 280/604 |
| 4,666,178 | A | * | 5/1987 | Matthews | 280/604 |
| 4,674,764 | A | * | 6/1987 | Miesen | 280/604 |
| 5,104,140 | A | | 4/1992 | Anderson | |
| 5,221,104 | A | * | 6/1993 | Bejean et al. | 280/604 |
| 5,344,177 | A | * | 9/1994 | Rouser et al. | 280/610 |
| 5,409,252 | A | | 4/1995 | Pieber | |
| 5,427,400 | A | * | 6/1995 | Bejean | 280/602 |
| 5,431,427 | A | | 7/1995 | Pieber et al. | |
| 5,829,776 | A | | 11/1998 | Deville et al. | |
| 6,079,746 | A | | 6/2000 | Olsen | |
| 6,105,990 | A | | 8/2000 | Sutherland | |

FOREIGN PATENT DOCUMENTS

| | | | | |
|---|---|---|---|---|
| FR | 0422382 A1 | * | 4/1991 | 280/604 |

* cited by examiner

*Primary Examiner*—Brian L. Johnson
*Assistant Examiner*—Bridget Avery
(74) *Attorney, Agent, or Firm*—AKC Patents; Aliki K. Collins

(57) ABSTRACT

A ski includes an elongated body having a bottom surface and a surface modifier having a first surface with a smooth texture and a second surface opposite to the first surface with a rough texture. The surface modifier is reversibly attached to the bottom surface of the elongated body thus providing the bottom surface with a smooth texture suitable for downhill skiing when the second rough textured surface is attached to the bottom surface and with a rough texture suitable for uphill and cross country skiing when the first smooth textured surface is attached to the bottom surface.

15 Claims, 7 Drawing Sheets

SKI FOR UPHILL AND DOWNHILL SKIING

FIELD OF THE INVENTION

The present invention relates to a ski, and more particularly to a ski that can be used for both uphill and downhill skiing.

BACKGROUND OF THE INVENTION

Skiing is a favorite winter sport and one of the oldest forms of transportation on snow covered grounds. Snow skis are attached to a skier's boots and are used either for skiing downhill or for cross-country and uphill skiing. Cross-country and uphill skis are relatively long, slender, have a uniform width, a light weight and are thicker in the middle compared to the front and back ends. Downhill skis are shorter, wider, have an hour-glass shape, uniform thickness and a heavier weight. For downhill skiing the bottom surface of the ski that comes in contact with the snow covered ground needs to be smooth, whereas for cross-country and uphill skiing the bottom surface is rough or has ridges in order to provide traction. In some cases a special type of wax is applied to the bottom surface of a cross-country and uphill ski in order to make it stick to the snow covered grounds.

A special type of skiing is called "Telemark skiing", named after a region in Norway. Telemark skiing was developed by Sondre Norheim and it involves uphill walking and downhill skiing. Telemark skiing may also include telemark turns (where the outside ski is advanced considerably ahead of the other ski and then turned inward at a steadily widening angle until the turn is completed), skating sections and jumps. In order to accommodate both the uphill walking and the downhill skiing, the texture of the bottom surface of the ski needs to be adapted.

One way of changing the texture of the bottom ski surface from smooth to rough is to attach climbing skins. There are two types of climbing skins, woven fabrics and plastic skins. Woven fabrics are usually attached to the bottom surface of a ski via an epoxy. In some cases, woven fabrics may have one self-sticking surface covered with wax paper. The wax paper is removed and the self-sticking surface of the woven fabric is attached to the bottom surface of the ski. The wax paper needs to be reapplied on the self-sticking surface of the woven fabric after the woven fabric is removed from the bottom surface of the ski. This process of removing and reattaching the wax paper on the self-sticking surface of the woven fabric is very cumbersome and especially difficult under harsh weather condition such as wind, snow or rain. Plastic skins are usually attached to the bottom surface of a ski via mechanical means. However, keeping the climbing skins attached to the bottom surface of a ski poses a significant challenge. The epoxy needs to be reapplied several times on the woven fabrics and the mechanical attachment of the plastic skins may break or needs to be reattached. Furthermore, the skier needs to carry with him the climbing skins during the downhill skiing and accessories for applying and carrying the climbing skins during both the uphill and the downhill skiing, which adds weight to the skier. Some systems are bulky to transport, do not function properly when they get wet and need to be frequently dried. It usually takes a long time to mount and dismount both types of the climbing skins on the skis and especially difficult under harsh weather condition such as wind, snow or rain.

Another method of providing traction during uphill and cross-country skiing is to use waxes. The wax melts and makes the bottom ski surface stick to the snow covered ground. However, waxes usually have a limited operational temperature range and do not provide sufficient traction.

There is a need for a ski that can accommodate both uphill and downhill skiing without the disadvantages of the existing systems.

SUMMARY OF THE INVENTION

In general, in one aspect, the invention features a ski including an elongated body having a bottom surface and a surface modifier. The surface modifier has a first surface with a smooth texture and a second surface opposite to the first surface with a rough texture. The surface modifier is reversibly attached to the bottom surface of the elongated body thus providing the bottom surface with a smooth texture suitable for downhill skiing when the second surface is attached to the bottom surface and with a rough texture suitable for uphill and cross country skiing when the first surface is attached to the bottom surface.

Implementations of this aspect of the invention may include one or more of the following features. The surface modifier may cover either the entire bottom surface of the elongated body or part of the bottom surface of the elongated body. In particular, the surface modifier may cover a centrally arranged and axially extending portion of the bottom surface of the elongated body. The elongated body further includes a front portion, a middle portion and a back portion and the surface modifier may have a first segment attached to the bottom surface of the front portion and a second segment attached to the bottom surface of the back portion. The surface modifier may be attached to the bottom surface via a tongue and groove type of attachment. In order to accomplish this type of attachment, the surface modifier may include at least one edge forming the male member of the tongue and groove attachment and the bottom surface of the elongated body may include at least one groove forming the female member of the tongue and groove attachment. Alternatively, the surface modifier may include at least one groove forming the female member of the tongue and groove attachment and the bottom surface of the elongated body includes at least one edge forming the male member of the tongue and groove attachment. The surface modifier may also be attached to the bottom surface via a dove tail type of attachment. The surface modifier may also be attached to the bottom surface by at least one screw and/or at least one bracket. The elongated body and the surface modifier may be made of a material such as wood, metal, plastic, foam, composites, laminates, and combinations thereof. The rough textured surface of the surface modifier may include at least one downward extending protrusion or at least one groove having a height in the range of 3 millimeters to 0.1 millimeters. The ski may further include a binding arranged on the top surface of the middle portion of the elongated body for attaching a skier's boot.

In general, in another aspect, the invention features a ski system including a set of two skis each ski having an elongated body having a bottom surface and a surface modifier. The surface modifier has a first surface with a smooth texture and a second surface opposite to said first surface with a rough texture. The surface modifier is reversibly attached to the bottom surface of the elongated body thus providing the bottom surface with a smooth texture suitable for downhill skiing when the second surface is attached to the bottom surface and with a rough texture suitable for uphill and cross country skiing when the first surface is attached to the bottom surface.

In general, in another aspect, the invention features a method of skiing using a ski system including a set of two skis each ski having an elongated body having a bottom surface and a surface modifier. The surface modifier has a first surface with a smooth texture and a second surface opposite to said first surface with a rough texture, a method of skiing. The method of skiing includes the steps of attaching the first smooth textured surface of the surface modifier to the bottom surface of each ski thus providing the bottom surface with a rough texture and then skiing uphill. Next, reversing the surface modifier and attaching the second rough textured surface of the surface modifier to the bottom surface of each ski thus providing the bottom surface with a smooth texture and then skiing downhill.

Among the advantages of this invention may be one or more of the following. The invention allows a skier to ski uphill and downhill without having to carry climbing skins or any other additional equipment for converting the uphill skis into downhill skis. The invention provides a ski that is easy to use. Since it does not use climbing skins it does not require the maintenance that is associated with them, such as needing to be dried, epoxied to the bottom of a ski or attaching wax paper to its self-sticking surface for storage. The ski according to this invention has a performance during down hill skiing comparable to a good Telemark ski. The performance of this ski during uphill skiing is at least as good or even better than a good wax-less cross-country ski. The time that it takes to convert the ski from the uphill to the downhill configuration is of the order of seconds. This ski can be used under any kind of weather conditions such as wind, snow or rain and with both hard-packed and light-packed type of snow. This ski may be used for uphill, downhill, cross-country, Telemark and Randonnee type of skiing, among others.

The details of one or more embodiments of the invention are set forth in the accompanying drawings and description below. Other features, objects and advantages of the invention will be apparent from the following description of the preferred embodiments, the drawings and from the claims.

BRIEF DESCRIPTION OF THE DRAWINGS

Referring to the figures, wherein like numerals represent like parts throughout the several views.

DETAILED DESCRIPTION OF THE INVENTION

Figure 1:
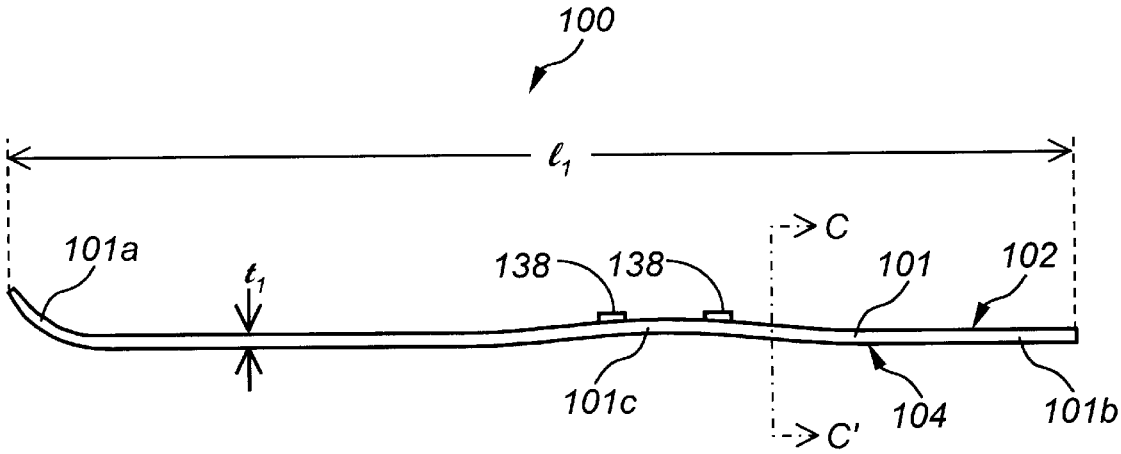
FIG. 1 (PRIOR ART)
FIG. 1 is a side view of a prior art downhill ski.

Referring to FIG. 1, a typical prior art downhill snow ski 100 includes an elongated main body 101 having a top surface 102, a bottom surface 104, a front end 101*a*, a rear end 101*b*, and a middle portion 101*c*. Bottom surface 104 comes in contact with the snow during downhill skiing and needs to be smooth in order to be able to glide over the snow. The front end 101*a* of the ski body 101 is usually curved upwards and the middle portion 101*c* forms an arc with the concave portion facing the ground. The top surface 102 includes a binding 138 for attaching the ski to the boots of the skier (not shown).

Figure 1A:
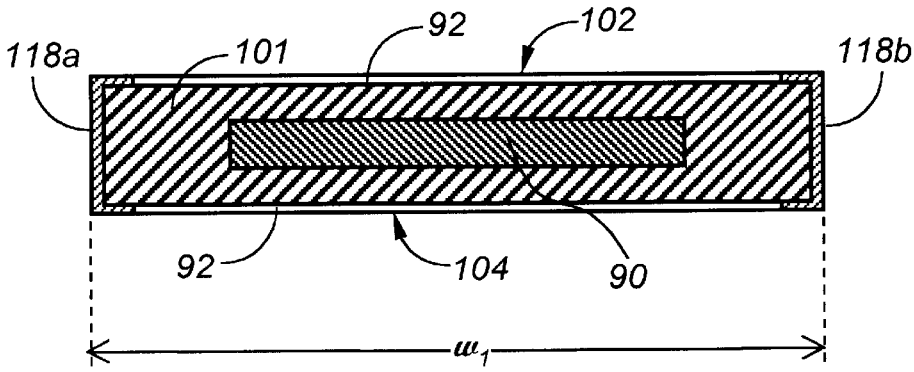
FIG. 1A (PRIOR ART)
FIG. 1A is a cross-sectional side view of the ski of FIG. 1 along CC'.

Referring to FIG. 1A, in one example, the ski 100 has a honeycomb core 90 surrounded by the main body 101. The top and bottom surfaces 102 and 104, respectively, of the main body 101 have a laminated finish 92 and the edges of the ski 118*a* and 118*b* are metallic brackets. Snow skis may be manufactured from a variety of materials including among others wood, metal, plastic, composite material, foam, or a combination thereof. In one example, the snow ski 100 has a length 11 of 190 cm, a width w1 that varies from 6.5 cm at the front 101*a* and rear 101*b* ends to 5.5 cm at the midpoint 101*c*, and a thickness t1 that varies from 0.95 cm at the front 101*a* and rear 101*b* ends to 1.3 cm at the midpoint 101*c*.

Figure 2:
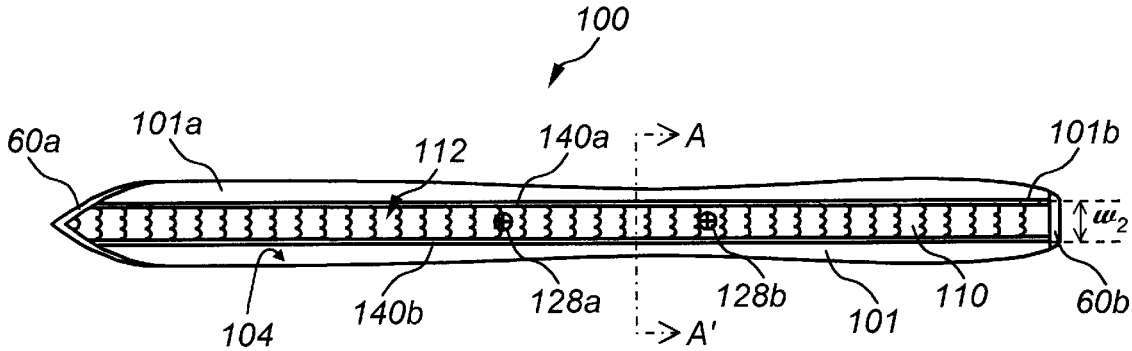
FIG. 2 is a bottom view of a ski according to this invention.
Figure 3:
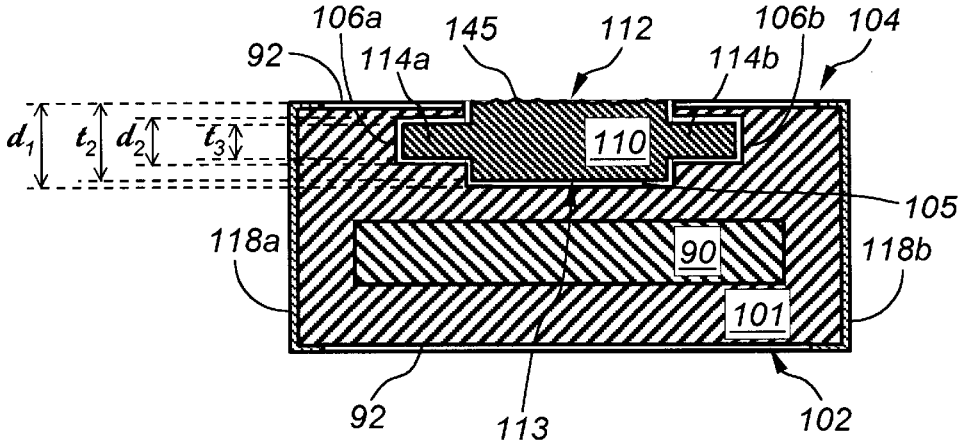
FIG. 3 is a cross-sectional side view of the ski of FIG. 2 along AA'.

Referring to FIG. 2, a snow ski 100 according to this invention includes an elongated main body 101 having a top surface 102, shown in FIG. 3, a bottom surface 104, and a surface modifier 110 attached to the bottom surface 104. The surface modifier 110 extends the entire length of the ski and covers the central portion of the bottom surface 104.

Referring to FIG. 3, the surface modifier 110 has a first surface 112 that has a rough texture and a second surface 113 that has a smooth texture. In one example, surface modifier 110 has a width w2 of 2 cm and a thickness t2 of 0.4 cm. First surface 112 includes downward extending protrusions 145 or ridges. The protrusions or ridges have a height of the order of 1 to 2 mm. Surface modifier 110 also has two side extensions 114*a*, 114*b* that extend the entire length of the surface modifier 110 along its sides 140*a* and 140*b*, respectively, shown in FIG. 2. Extensions 114*a*, 114*b* have a thickness t3 of 0.2 cm, which is smaller than the thickness t2. In the embodiment of FIG. 3, the main body 101 of the ski 100 has a slot 105 formed near its bottom surface 104. Slot 105 has two side slots 106*a*, 106*b* formed on the side surfaces of the slot 105 that extend the entire length of slot 105. Slot 105 has a depth d1 of 0.5 cm and side slots 106*a*, 106*b* have a depth of 0.25 cm. Surface modifier 110 is inserted into the slot 105 from either the rear end 101*b* or the front end 101*a* and is held in place by a tongue and groove type of attachment. Extensions 114*a*, 114*b* of the surface modifier 110 form the male surfaces and side slots 106*a*, 106*b* of the slot 105 form the female surfaces for mating the sides of the surface modifier 110 and slot 105 in a tongue and groove fashion. This tongue and groove type of attachment holds the surface modifier 110 in place and prevents it from moving sidewise. Longitudinal motion of the surface modifier 110 is prevented by two screws 128*a*, 128*b*, and front and back brackets 60*a*, 60*b*, respectively, shown in FIG. 2.

Figure 4:
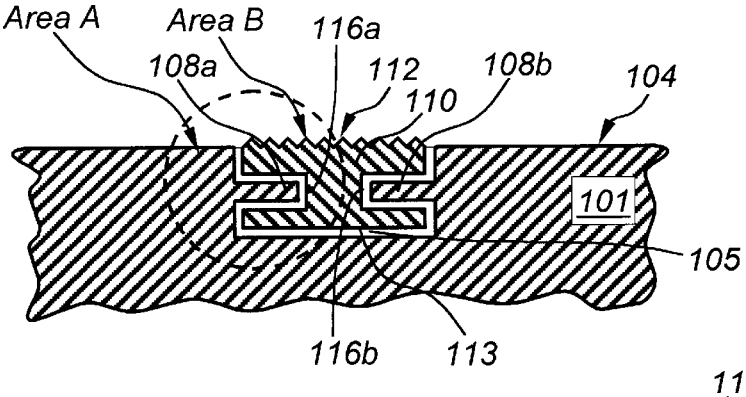
FIG. 4 is an alternative partial cross-sectional side view of the ski of FIG. 2 along AA'.

In an alternative embodiment, shown in FIG. 4, the tongue and groove attachment configuration is reversed. In this embodiment the slot 105 has side extensions 108*a*, 108*b* that form the male surfaces and surface modifier 110 has side slots 116*a*, 116*b* that form the female surfaces for mating the sides of the surface modifier 110 and slot 105 in a tongue and groove fashion.

Figure 5A:
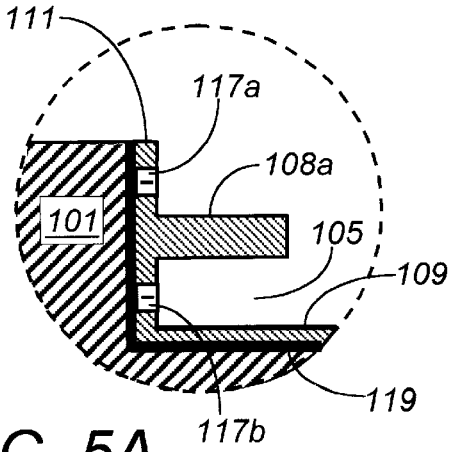
FIG. 5A is a detailed view of area A of FIG. 4.
Figure 5B:
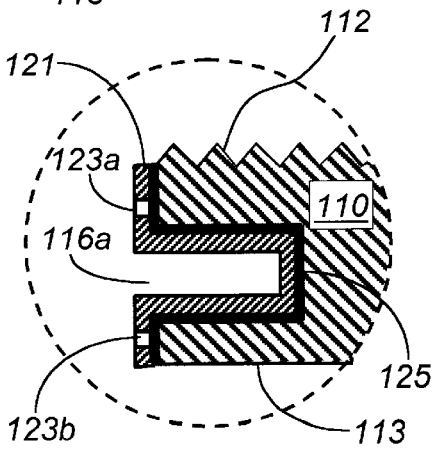
FIG. 5B is a detailed view of area B of FIG. 4.

Referring to FIG. 5A, in another embodiment, the extensions 108*a*, 108*b* and the interior surfaces 109 of the slot 105 are part of a lining 111 covering the interior walls of slot 105. In one example, lining 111 is formed by a different material than the main body 101. Lining 111 of the slot 105 is attached to the slot via screws 117*a*, 117*b* and an epoxy 119. Similarly, the side slots 116*a*, 116*b* and the sides of the surface modifier 110 are part of a lining 121 covering the sides of the surface modifier 110, as shown in FIG. 5B. In one example, lining 121 is formed by a different material than the surface modifier 110. Lining 121 of the sides of the surface modifier 110 is attached to the surface modifier via screws 123*a*, 123*b* and an epoxy 125. Linings 111, 121 may be manufactured by a variety of materials including among others metal, plastic, composites and wood.

Figure 6A:
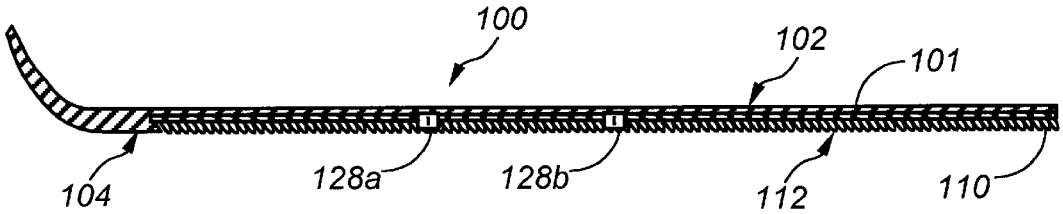
FIG. 6A is a cross-sectional side view of the ski of FIG. 2 in the uphill configuration.
Figure 6B:
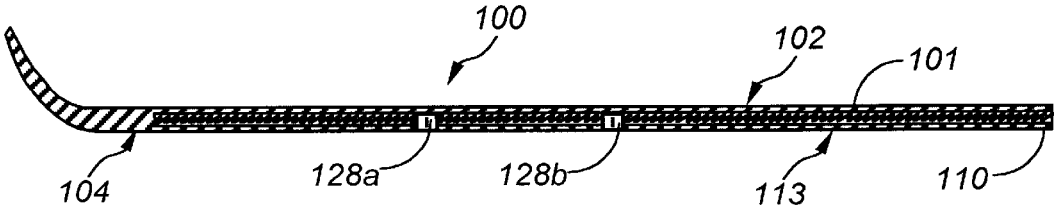
FIG. 6B is a cross-sectional side view of the ski of FIG. 2 in the downhill configuration.

Referring to FIG. 6A and FIG. 6B, the surface modifier 110 can be inserted and attached to the bottom surface 104 of the ski 100 having either rough surface 112 or smooth surface 113 facing the outside of the ski. The configuration of FIG. 6A where the rough surface 112 of the surface modifier 110 is facing the outside of the bottom ski surface 104 is appropriate for skiing uphill, whereas, the configuration of FIG. 6B where the smooth surface 113 of the surface modifier 110 is facing the outside of the bottom ski surface 104 is used for downhill skiing.

Figure 7:
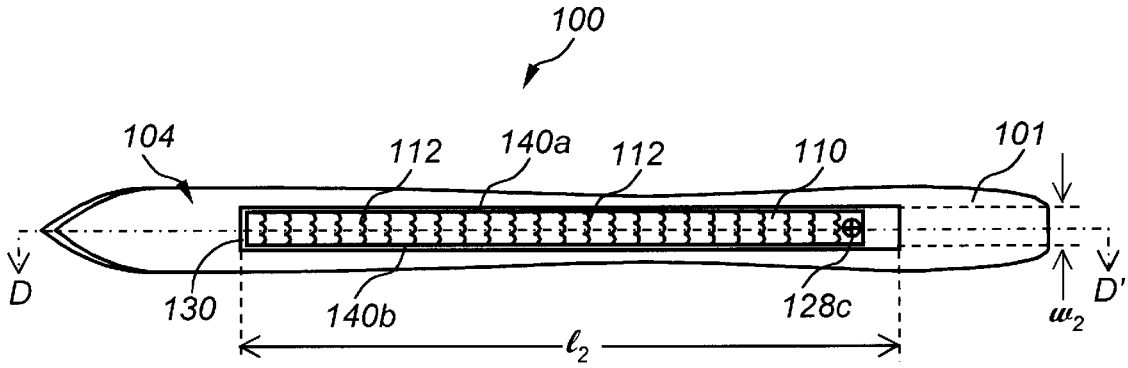
FIG. 7 is a bottom view of an alternative embodiment of a ski according to this invention.
Figure 8:
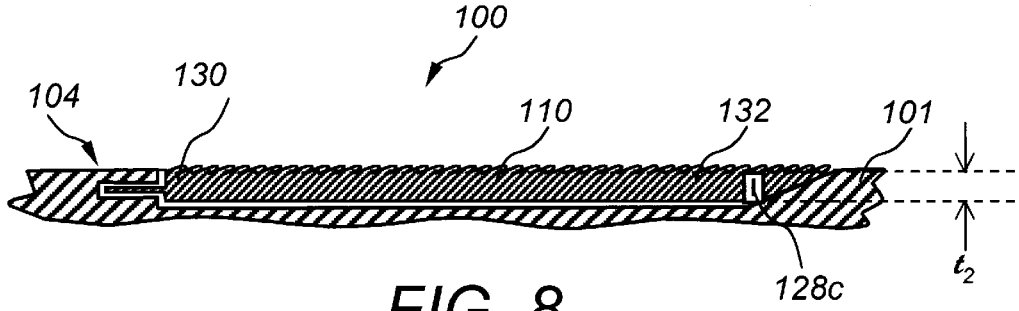
FIG. 8 is a partial cross-sectional side view of the ski of FIG. 7 along DD'.

Referring to FIG. 7, in another embodiment, the surface modifier 110 covers only the central middle portion of the bottom surface 104 of the ski main body 101 and does not extend the entire length of the ski. In one example of this embodiment, the surface modifier 104 has a length 12 of 100 cm a width w2 of 2 cm and a thickness t2 of 0.4 cm. In this embodiment the surface modifier 110 is attached to the bottom surface 104 of the ski main body 101 by tongue and groove type attachments along the sides 140*a*, 140*b* of the surface modifier 110 and at the front end 130 of the surface modifier 110, as shown in FIG. 8. The back end 132 of the surface modifier 110 is attached to the ski main body by a screw 128*c*.

Figure 9:
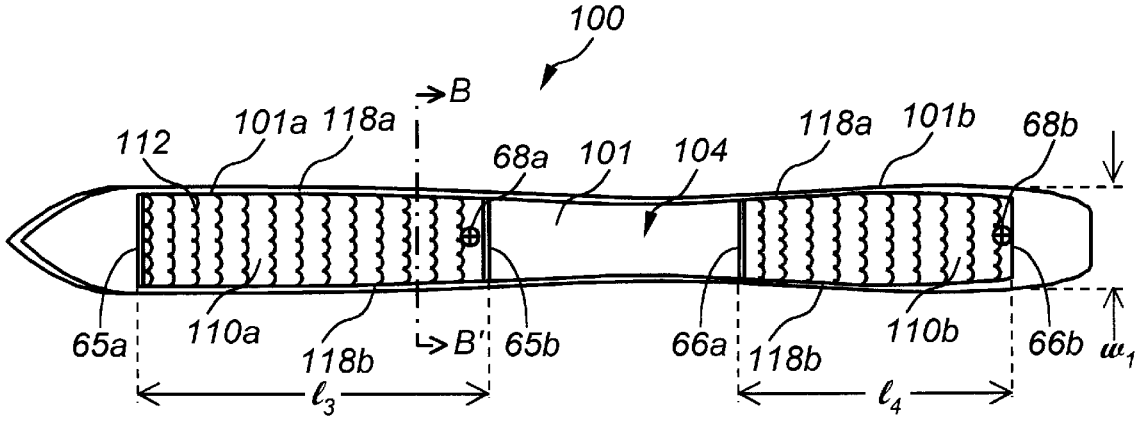
FIG. 9 is a bottom view of yet another alternative embodiment of a ski according to this invention.

Referring to FIG. 9, in yet another alternative embodiment of this invention, two surface modifiers 110*a* and 110*b* are attached to the front end 101*a* and the rear end 101*b* of the bottom surface 104 of the ski main body 101, respectively. In one example, surface modifiers 110*a* and 110*b* have lengths 13 of 81 cm and 14 of 84 cm, respectively, and a thickness t2 of 0.4 cm. In this example surface modifiers 110*a*, 110*b* extend to the edges of the main body 101 and cover the entire width w1 of the bottom surface 104.

Figure 10:
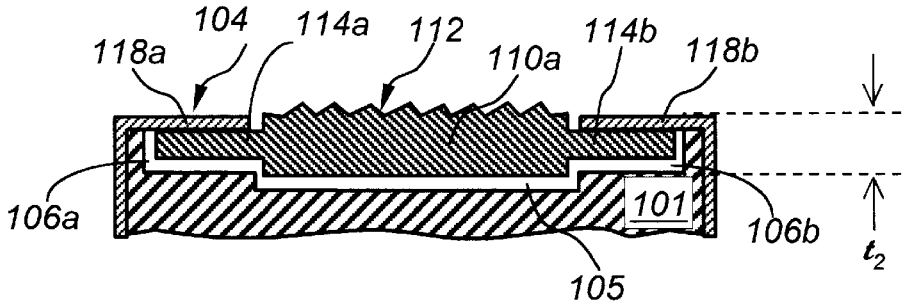
FIG. 10 is a partial cross-sectional side view of the ski of FIG. 9 along BB'.

Referring to FIG. 10, the external metallic brackets 118*a*, 118*b* that form the edges of the main body 101 are also used to form the upper lips of slots 106*a*, 106*b*, respectively, formed at the bottom surface 104 of the main body 101. Slots 106*a*, 106*b*, form the female surfaces and extensions 114*a*, 114*b* of the surface modifier 110*a* form the male surfaces for the tongue and groove attachment of the surface modifier 110*a* to the bottom surface 104 of the ski main body 101. The front ends 65*a* and 66*a* of the surface modifiers 110*a*, 110*b*, respectively, are also secured to the bottom surface 104 via a tongue and groove type attachment similar to the one shown in FIG. 8. The back ends 65*b* and 66*b* of the surface modifiers 110*a*, 110*b*, respectively, are secured to the bottom surface 104 by screws 68*a*, 68*b*, respectively.

Figure 11:
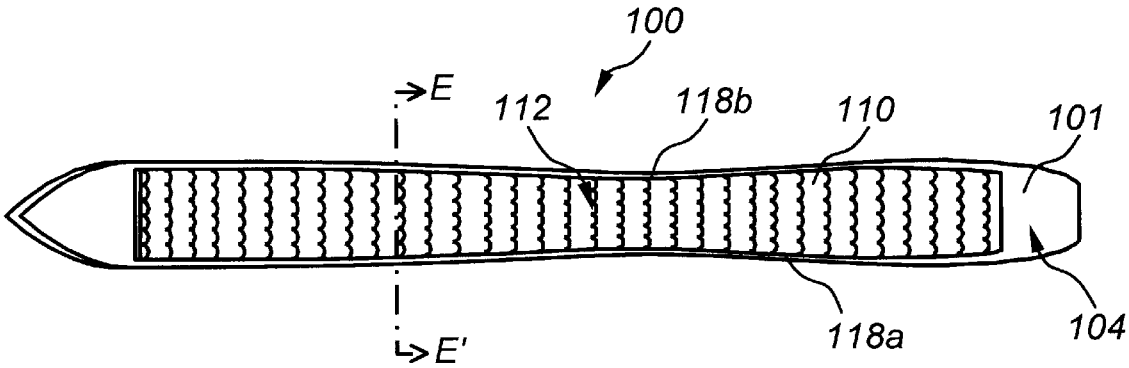
FIG. 11 is a bottom view of yet another alternative embodiment of a ski according to this invention.
Figure 12A:
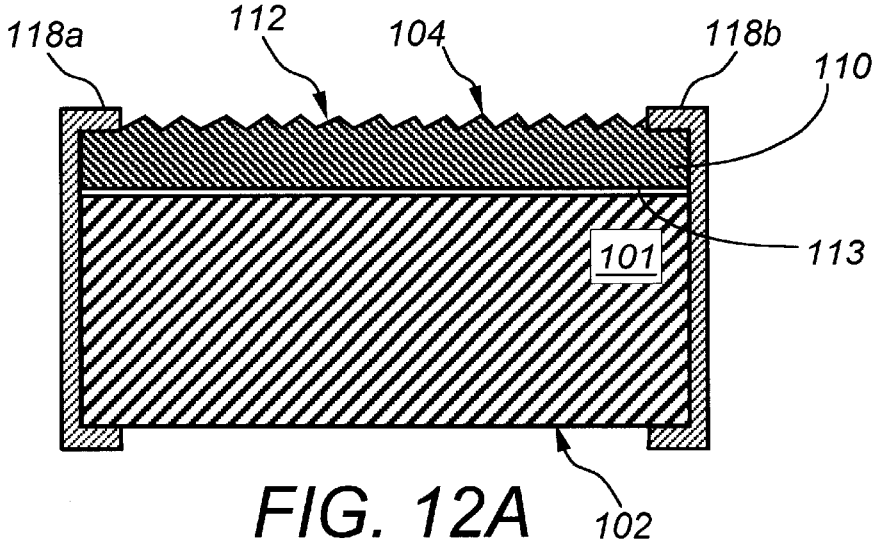
FIG. 12A is a cross-sectional side view of the ski of FIG. 11 along EE'.

Referring to FIG. 11 and FIG. 12A, in another embodiment, surface modifier 110 comprises an elongated body extending the entire width of the bottom surface 104 and almost the entire length of the ski. Surface modifier 110 is held together on top of the bottom surface 104 of the main body 101 by brackets 118*a* and 118*b*. Brackets 118*a* and 118*b* run along the sides of the ski and extend almost the entire length of the ski body 101.

Figure 12B:
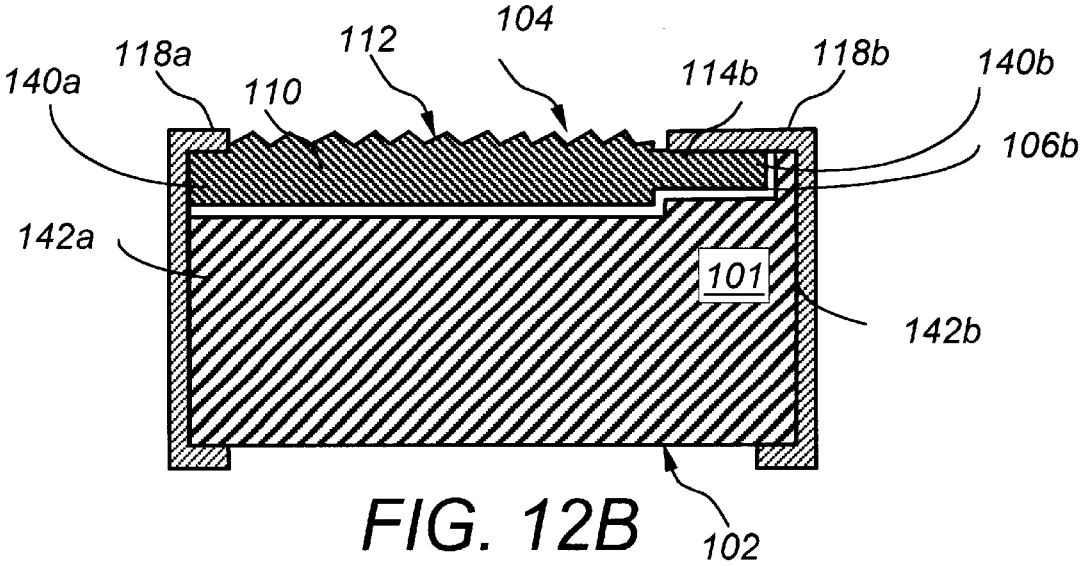
FIG. 12B is an alternative cross-sectional side view of the ski of FIG. 11 along EE'.

Referring to FIG. 12B, in an alternative embodiment, one side 140*a* of the surface modifier 110 is attached to the bottom surface 104 of the ski main body 101 via a groove and tongue type attachment and the other side 140*b* is held together on top of the bottom surface 104 via the metallic bracket 118*b*. Side 140*b* of the surface modifier 110 has an extension 114*b*, which forms the male surface of the groove and tongue attachment. Side 140*a* of the surface modifier 110 is flat. The main body 101 has a side slot 106*b* formed at one of the side edges 142*b* of its bottom surface 104. Side slot 106*b* forms the female surface for the groove and tongue attachment. The upper lip of the side slot 106*b* is formed by the metallic bracket 118*b*. In order to attach the surface modifier 110 to the bottom surface 104 of the main body 101, extension 114*b* is inserted into side slot 106*b* first, to form a groove and tongue type attachment. Next, metal bracket 118*a* is slipped over the flat side 140*a* of the surface modifier 110 and side 142*a* of the main body 101 thus holding them together. The opposite sequence is followed for detaching the surface modifier 110 from the main body 101.

Figure 13:
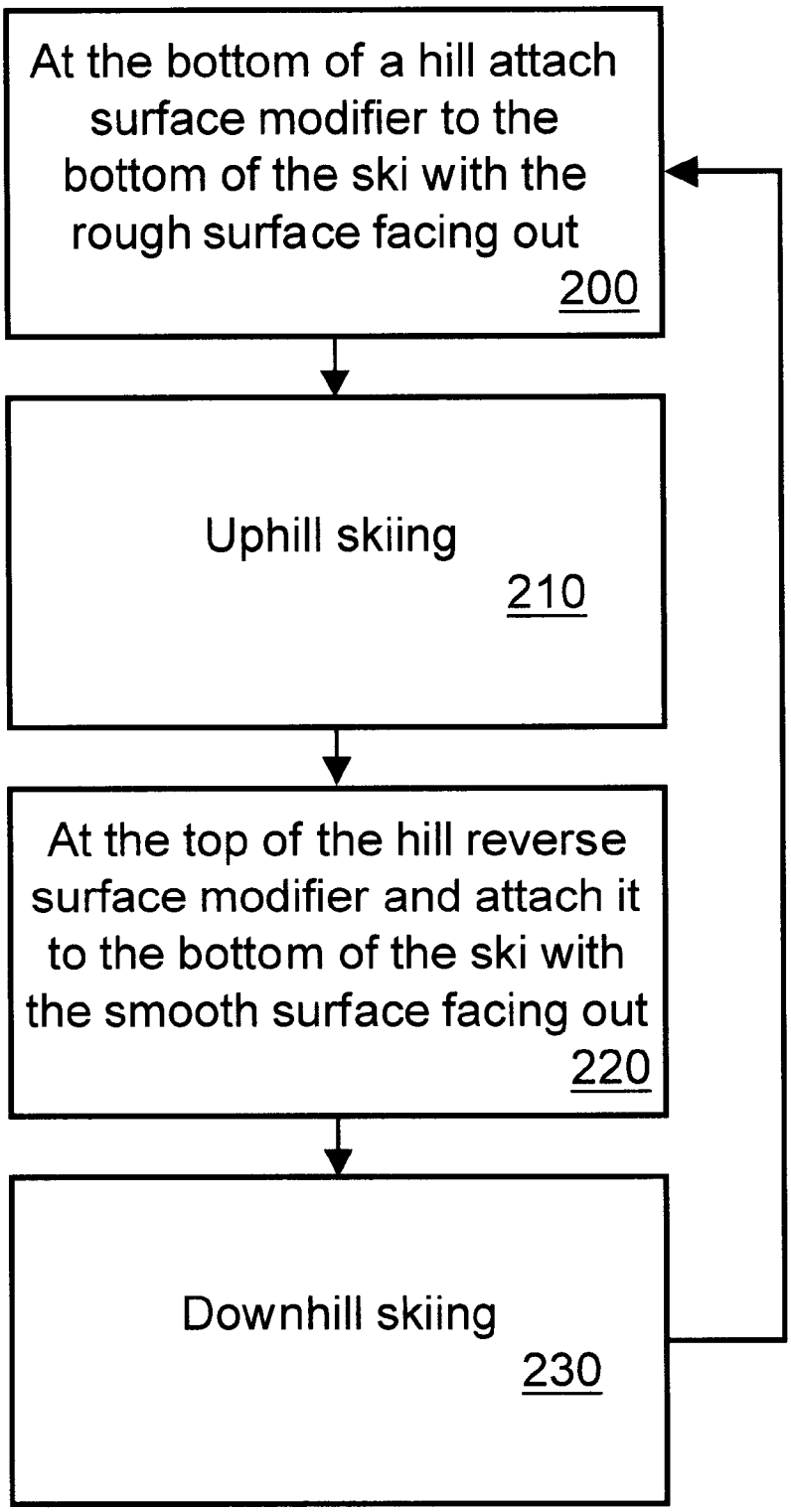
FIG. 13 is a flow diagram depicting the method of using the ski according to this invention for uphill and downhill skiing.

Referring to FIG. 13, a method of skiing using the ski of this invention includes the following steps. In step 200 a skier is at the bottom of a hill and attaches surface modifier 110 to the bottom 104 of the ski main body 101 with the rough surface 112 facing out. Next the skier proceeds with skiing uphill 210. When he/she arrives at the top of the hill, he/she reverses the surface modifier 110 and attaches it to the bottom 104 of the ski main body 101 with the smooth surface 113 facing out, 220. Next, he/she proceeds with skiing downhill 230. This process is repeated several times.

Other embodiments are within the scope of the following claims. For example, surface modifier 111 may be attached to the bottom surface 104 of the ski main body 101 via a dove tail type attachment and screws. More than two screws may be used to attach surface modifier 111 to the bottom surface 104 of the ski main body 101.

Several embodiments of the present invention have been described. Nevertheless, it will be understood that various modifications may be made without departing from the spirit and scope of the invention. Accordingly, other embodiments are within the scope of the following claims.

What is claimed is:

1. A ski comprising:

an elongated body having a bottom surface, a top surface, a first elongated side, a second elongated side, a front end and a back end;

a surface modifier having a first surface with a smooth texture, a second surface opposite to said first surface with a rough texture, a first side, a second side, a front end and a back end;

a first removable elongated bracket;

a second removable elongated bracket; and wherein said surface modifier is adapted to be reversibly attached to said bottom surface of the elongated body by placing said surface modifier on top of said bottom surface of said elongated body with either said first surface or said second surface of said surface modifier facing said bottom surface, and attaching said first elongated side of said elongated body to said first side of said surface modifier, and said second elongated side of said elongated body to said second side of said surface modifier, via said first and second removable elongated brackets, respectively, thereby providing said bottom surface with a smooth texture suitable for downhill skiing when said second surface of said surface modifier faces said bottom surface of said elongated body and with a rough texture suitable for uphill and cross country skiing when said first surface of said surface modifier faces said bottom surface of said elongated body.

2. The ski of claim 1 wherein said surface modifier covers the entire bottom surface of said elongated body.

3. The ski of claim 1 wherein said surface modifier covers part of the bottom surface of said elongated body.

4. The ski of claim 1 wherein said elongated body comprises a front portion, a middle portion and a back portion and said surface modifier comprises a first segment attached to the bottom surface of said front portion and a second segment attached to the bottom surface of said back portion.

5. The ski of claim 1 wherein said surface modifier is further attached to said bottom surface by at least one screw.

6. The ski of claim 1 wherein said elongated body comprises a material selected from a group consisting of wood, metal, plastic, foam, composites, laminates, and combinations thereof.

7. The ski of claim 1 wherein said surface modifier comprises a material selected from a group consisting of wood, metal, plastic, foam, composites, laminates, and combinations thereof.

8. The ski of claim 1 wherein said rough textured surface of said surface modifier comprises at least one downward extending protrusion.

9. The ski of claim 1 wherein said rough textured surface of said surface modifier comprises at least one groove.

10. The ski of claim 1 further comprising a binding arranged on the top surface of said elongated body for attaching a skier's boot.

11. The ski of claim 1 wherein said surface modifier is further attached to said bottom surface of said elongated body by third and fourth removable brackets attaching said front end of said surface modifier to said front end of said elongated body and said back end of said bottom surface to said back end of said elongated body, respectively.

12. The ski of claim 8 downward wherein said at least one downward extending protrusion has a height in the range of 3 millimeters to 0.1 millimeters.

13. A ski comprising:

an elongated body having a bottom surface, a top surface, a front end, a back end, a first elongated side extending longitudinally from said front end to said back end, and vertically from said top surface to said bottom surface, a second elongated side extending longitudinally from said front end to said back end and vertically from said top surface to below said bottom surface, and an elongated longitudinal slot formed within said second elongated side extending longitudinally from said front end to said back end and defining a cavity with an opening below said bottom surface;

a pair of removable elongated brackets;

a surface modifier having a first surface with a smooth texture, a second surface opposite to said first surface with a rough texture, a first side, a second side, a front end and a back end, wherein said surface modifier is adapted to be reversibly attached to said bottom surface of said elongated body with either said second surface or said first surface facing said bottom surface, thereby providing said bottom surface with a smooth texture suitable for downhill skiing or with a rough texture suitable for uphill and cross country skiing, respectively; and wherein said surface modifier is reversibly attached to said bottom surface by placing said second side of said surface modifier within said cavity of said elongated slot formed within said second elongated side of said elongated body, wherein one elongate bracket of said pair of elongate brackets securing said second side of said surface modifier within said elongated side of said elongate body and attaching said first elongated side of said elongated body and said first side of said surface modifier via said other elongate bracket of said pair of removable elongated brackets.

14. The ski of claim 13 wherein said surface modifier is further attached to said bottom surface by at least one screw.

15. The ski of claim 13 wherein said surface modifier is further attached to said bottom surface of said elongated body by first and second removable brackets attaching said front end of said surface modifier to said front end of said elongated body and said back end of said bottom surface to said back end of said elongated body, respectively.

* * * * *